United States Patent [19]

Synan

[11] 4,257,390

[45] Mar. 24, 1981

[54] ANDIRON AND HEAT DISTRIBUTION UNIT

[76] Inventor: Albert M. Synan, 5111 Woodland Dr., Fredericksburg, Va. 22401

[21] Appl. No.: 2,203

[22] Filed: Jan. 9, 1979

[51] Int. Cl.[3] ..... F24B 7/00; F16L 11/00

[52] U.S. Cl. ..... 126/121; 126/164; 237/51; 138/38

[58] Field of Search ..... 126/120, 126, 121, 164, 126/165, 163 R, 298, 990; 237/51; D7/207; 138/38

[56] References Cited

U.S. PATENT DOCUMENTS

| | | | |
|---|---|---|---|
| 2,828,078 | 3/1958 | Snodgrass | 237/51 |
| 3,001,521 | 9/1961 | Reilly | 126/121 |
| 3,452,737 | 7/1969 | Pelligrino et al. | 126/121 |
| 3,911,894 | 10/1975 | Richard, Jr. et al. | 126/121 |
| 3,945,369 | 3/1976 | Adams et al. | 126/164 |
| 4,008,706 | 2/1977 | Buanno | 126/121 |
| 4,010,729 | 3/1977 | Egli | 126/121 |
| 4,018,208 | 4/1977 | Hamilton | 126/121 |
| 4,068,650 | 1/1978 | Nelson | 126/121 |
| 4,076,012 | 2/1978 | Meeker | 126/164 |
| 4,078,542 | 3/1978 | Young et al. | 126/164 |

FOREIGN PATENT DOCUMENTS

| | | | |
|---|---|---|---|
| 2471 | of 1898 | United Kingdom | 126/121 |

*Primary Examiner*—Samuel Scott
*Assistant Examiner*—Randall L. Green
*Attorney, Agent, or Firm*—Lowe, King, Price & Becker

[57] ABSTRACT

First and second, complementary andirons supporting opposite ends of fuel logs in a fireplace are adapted to increase heat transfer to a room. Each andiron comprises a hollow, U-shaped andiron housing with adjacent ends forming, respectively, an inlet and an outlet. A blower attached to the inlet establishes a stream of forced air within the housing and through the outlet into the room. A heat exchanger, formed of a solid rod member with adjacent members in contact with each other, is distributed along the interior of the housing to transfer stored heat energy to the air stream. An adjustable air director at the outlet enables the heated air to be directed toward any portion of the room.

6 Claims, 7 Drawing Figures

ANDIRON AND HEAT DISTRIBUTION UNIT

TECHNICAL FIELD

The present invention relates generally to apparatus for increasing the heating efficiency of a conventional stove or fireplace, and more particularly, toward an andiron system having a blower for establishing an air stream through the andiron and into a room and an efficient heat exchanger within the andiron for transferring stored heat energy to the air stream.

BACKGROUND ART

Numerous systems have been developed in recent years for increasing the amount of heat transfer from a stove or fireplace to a room in order to reduce total heating requirements by the home heating plant. These devices have typically been provided in the form of andirons or grates having blowers for establishing a stream of heated air from the stove or fireplace to the room to thereby heat the room by convection. This approach has substantially increased the heating efficiency of conventional stoves and fireplaces since, in the absence of such devices, heat transfer between a stove or fireplace and room is principally by radiation. Radiation constitutes only about five percent of the heat generated by the fuel, the remainder being wasted through the chimney.

One type of andiron design of the prior art, as shown in Hamilton U.S. Pat. No. 4,018,208, has included a hollow, C-shaped andiron through which air is blown. Heat transfer to the forced air is principally at the interface between the air and inner wall surface of the andiron. In order to increase the heat transfer from the hollow andiron to the air stream, Young et al. U.S. Pat. No. 4,078,542 has proposed filling a hollow grate with a sheet metal, fin matrix. The fin matrix structure, however, has been found to be difficult to manufacture. Also, it has been observed that there is a tendency for ashes and particulate matter to be recirculated into the grate through the blower and to accumulate on the fins, thereby reducing the amount of air flowing through the system. The fin type matrix is difficult to thereafter clean, and any crimping of the fin structure during cleaning permanently decreases air flow and reduces the efficiency of heat transfer to the room.

The fin type heat exchange structure, although having a high surface area-to-volume ratio which does efficiently transfer heat to the air stream, is not capable of storing a substantial amount of heat. After combustion of the fuel has been completed, therefore, no substantial amount of heat can be drawn from the fins for continued heat transfer to the room.

OBJECTS OF THE INVENTION

One object of the present invention, therefore, is to provide a new and improved apparatus for increasing the efficiency of a stove or fireplace.

Another object is to provide an apparatus having improved heat transfer characteristics which supports fuel in a stove or fireplace and transfers heat to a room.

Another object is to provide a stove or fireplace andiron of a type having an air blower for transferring air heated in the andiron to a room, wherein efficiency of heat transfer is improved over the prior art.

Another object is to provide a convection type heat exchange unit for a stove or fireplace, wherein heat energy stored in the unit is transferred to a room even after combustion of the fuel has extinguished.

Another object is to provide a new and improved, combination andiron and air blower system having relatively low manufacturing costs and improved ease of maintenance.

DISCLOSURE OF INVENTION

A combination andiron and air blower system, in accordance with the invention, comprises first and second, complementary andiron units positioned within the cavity of a conventional stove or fireplace and spaced apart to support opposite ends of natural or artificial fuel logs. Each andiron is formed of a hollow, U-shaped housing mounted on the fireplace floor by a set of legs. Adjacent ends of the housing extending outwardly from the rear of the stove or fireplace form, respectively, an air inlet and an air outlet. A conventional blower is attached to the inlet and operated to establish a stream of forced air through the interior of the housing outwardly through the outlet to heat the adjoining room by convection.

A liner located against the inner wall surface of the housing is formed with a series of cutouts adapted to support an improved heat exchange unit within the flow path of the forced air stream. The heat exchange unit comprises a matrix of horizontal, solid rod members distributed throughout the housing. Adjacent rod members are mutually orthogonal and are in contact with each other to receive heat by conduction through the housing and neighboring rod members as well as by convection. The orthogonal structure of the matrix provides maximum heat transfer from the rods to the air stream as the stream flows along the surface of longitudinal rod members intermittently impinging against the surfaces of transverse members. Heat transfer to the air stream occurs even after combustion of the fuel logs has extinguished, since the heat exchange matrix is massive enough to store a substantial quantity of heat energy. Air heated in the andiron by the matrix is directed to the room through an adjustable air director at the outlet of the housing.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

BEST MODE FOR CARRYING OUT THE INVENTION

Figure 1:
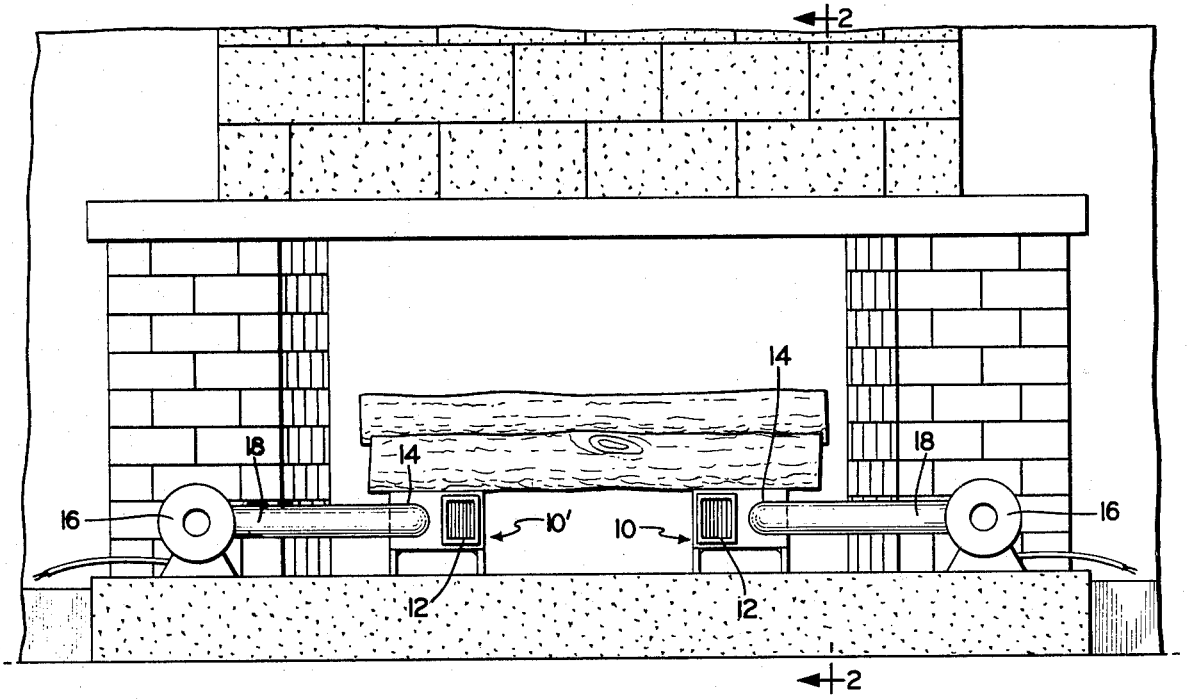
FIG. 1 is a front view of the andiron system of the invention within a fireplace and supporting a number of fuel logs to be burned.
Figure 2:
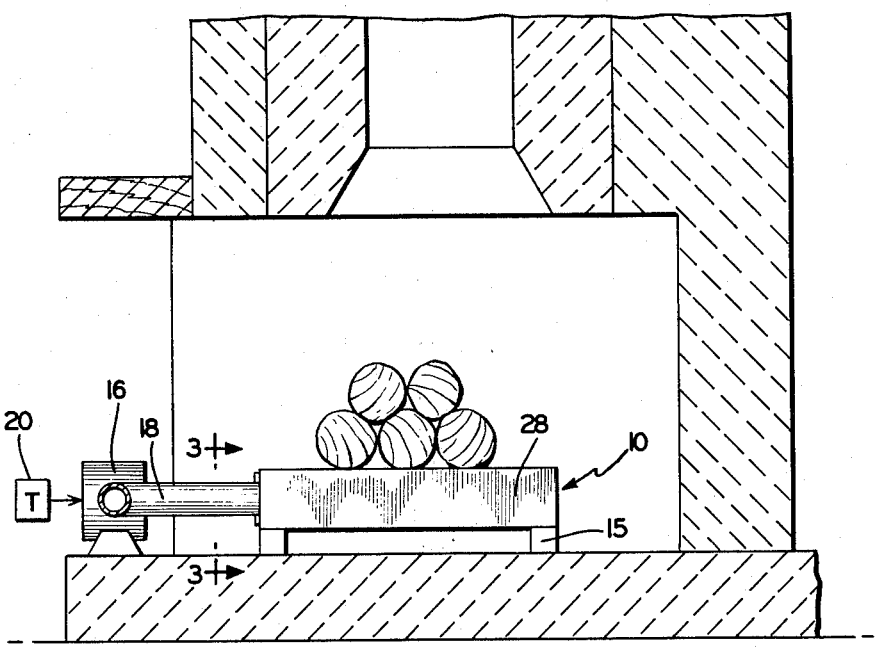
FIG. 2 is a side view of the andiron system taken along the line 2—2 in FIG. 1.
Figure 3:
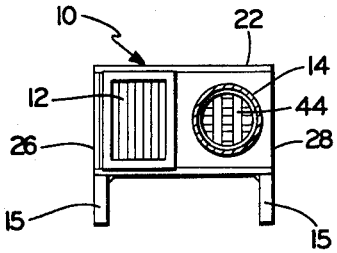
FIG. 3 is a front view of one of the andirons shown in FIG. 2 with the blower hose viewed in cross section to expose details of the inlet.

Referring to FIGS. 1 and 2, first and second andirons, in accordance with the present invention, are designated, respectively, by 10 and 10′ within a conventional fireplace cavity. A fireplace is shown in the Figures and described herein by way of example; it is understood, however, that the andirons 10, 10′ could be also utilized within a stove or furnace. The andirons 10, 10′ are complementary, that is, they are provided with air outlets 12 that are both oriented toward the center of the fireplace and are provided with air inlets 14 that are both oriented on sides of the inlets opposite the cavity center. Andirons 10, 10′ are adapted to be located in the positions shown in FIG. 1 to support the opposite ends of natural or artificial fireplace fuel logs above the fireplace floor. A conventional blower 16 is connected to the inlet 14 of each andiron 10, 10′ through a blower hose 18. The complementary structural relationship between the two andirons 10, 10′ enables the blowers 16 to be positioned outside the fireplace cavity at opposite sides of the fireplace as shown without causing either one of the blower hoses 18 to block a corresponding air outlet 12. The complementary relationship further exposes air within each andiron to heat generated by hot coals on the fireplace floor between the andirons immediately prior to egress of air through the outlets 12 into the room in the manner described in detail below. Both andirons 10, 10′ are mounted on the fireplace floor by legs 15.

Preferrably, blower 16 is a conventional, electrically operated blower unit of sufficient capacity to establish a steady stream of forced air through the andirons 10, 10′ into the room to be heated. The flow rate of the blowers 16 is low enough to enable substantial heating of the air within the andirons 10, 10′ for maximum heat transfer to the room. The blowers 10 may be thermostatically controlled, as shown schematically at 20 in FIG. 2, to operate intermittently to maintain a preselected, ambient temperature in the room.

Figure 4:
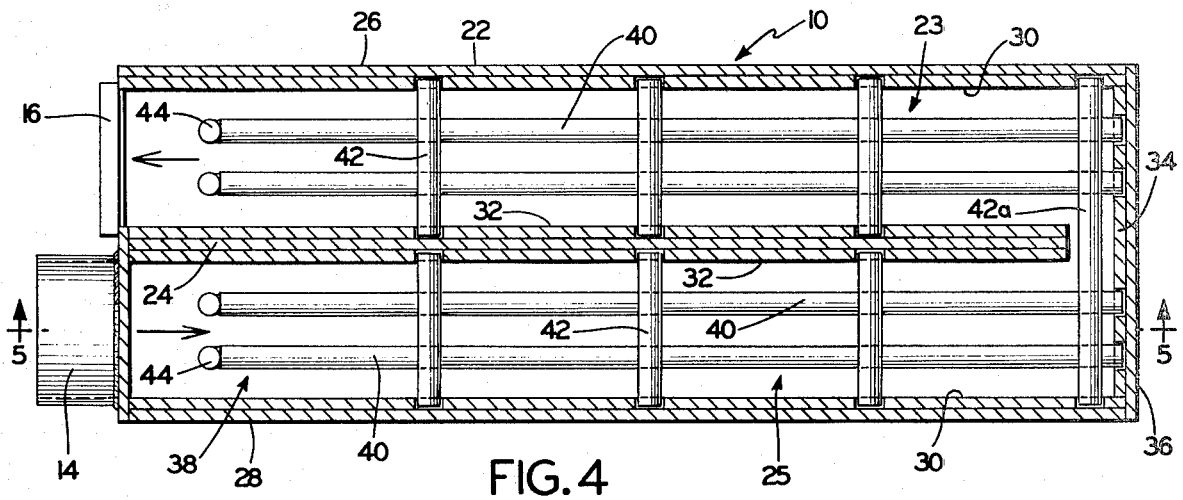
FIG. 4 is a cross sectional top view of one andiron showing the transverse rod members in detail.
Figure 5:
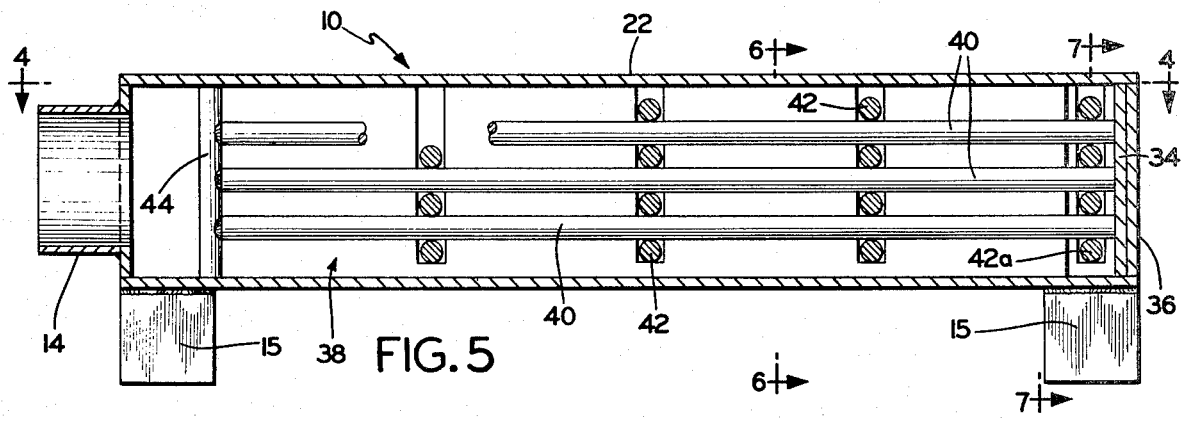
FIG. 5 is a cross sectional side view of one of the andirons taken along the line 5—5 in FIG. 4 to show the interleaving relationship of longitudinal and transverse rod members in the heat exchange matrix.

Referring to FIGS. 4 and 5, andiron 10 comprises a hollow, U-shaped andiron housing 22 having sections 23, 25 of the "U" defined by a dividing wall 24 and having the ends of the "U" forming, respectively, the inlet 14 and outlet 16. The inlet 14 is a tubular section adapted to receive hose 18, as shown in FIG. 1. Outlet 16 is preferably a conventional, adjustable air director unit to direct flow of heated air from the andiron 10 in any direction for best heat distribution in the room.

The dividing wall 24 is located within the housing 22 equally spaced from opposite sidewalls 26, 28. The dividing wall 24 in addition to establishing the U-shaped internal configuration of the housing 22, causes air supplied to inlet 14 by blower 16 to follow a serial flow path through the two contiguous housing sections 23, 25.

Figure 6:
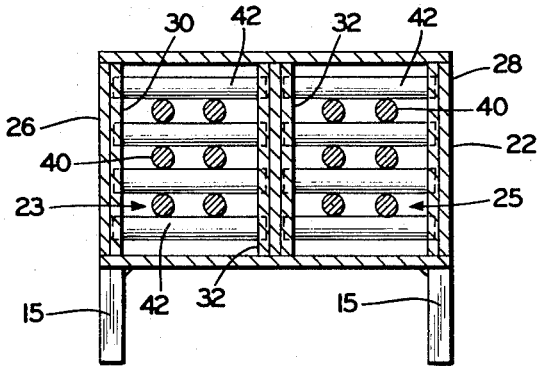
FIG. 6 is a cross sectional front view of the andiron taken along the line 6—6 in FIG. 5.
Figure 7:
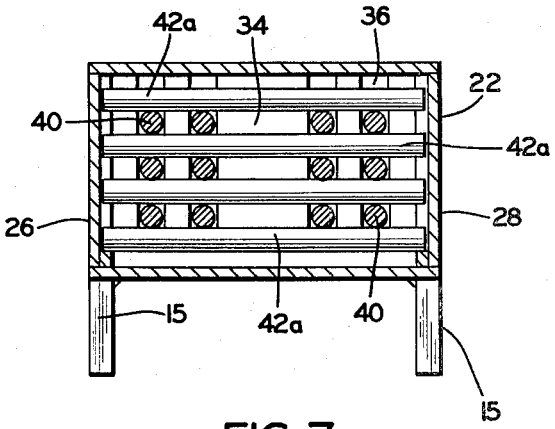
FIG. 7 is a cross sectional view of the andiron taken along line 7—7 in FIG. 5.

A liner 30 is located against each inner surface of sidewalls 26 and 28. Additional liners 32 are located on the surfaces of the divider 24 and another liner 34 is located on the inner surface of rear wall 36 of the housing 22. The liners 30, 32 and 34 are formed with cut outs 36, as shown in FIGS. 4 and 5, for receiving and supporting within the housing 22 a heat exchange matrix 38 which is constituted by an array of horizontal, solid rod members distributed throughout the interior of the housing 22. Longitudinal rod members 40 are arranged in a 2×3 array in each leg of the housing, as shown in FIGS. 6 and 7, and are interleaved with a series of transverse rod members 42 distributed along each section of the housing 22 (see FIGS. 4 and 5). Whereas the transverse rod members 42 have a length equal to about one half the width of the andiron 10 since each rod extends only between one of the outer sidewalls 26, 28 and the dividing wall 24, the rear set of transverse rod members 42A (see FIG. 7) extends between the two outer sidewalls.

The ends of the longitudinal rod members 40 are supported within the andiron housing 22 by vertical rod members 44, as shown in FIGS. 5 and 6. The remaining ends of the longitudinal rod members 40 and transverse rod members 42 and 42A are supported by the housing liners 30, 32 and 34 as described above.

As best shown in FIG. 5, adjacent ones of the interleaved longitudinal rod members 40 and transverse rod members 42, 42A are mutually orthogonal and in contact with each other. Thus, the closest longitudinal rod members 40 are spaced apart from each other by the diameter of the transverse rod members 42 and are in contact with diametrically opposed portions of the transverse members. Similarly, the transverse rod members 42 are spaced apart from each other by the diameter of the longitudinal rod members 40 and are in contact with diametrically opposed portions of the longitudinal members. Each of the rod members 40 and 42, 42A has at least one end in contact with one of the housing liners 30, 32 and 34.

When fuel is burned in the fireplace, the housing 22 of each andiron 10, 10′ is heated by the flame of combustion and also by hot coals that tend to fall between the andirons onto the fireplace floor. Heat in the housing 22 of each andiron enters the interior of the housing through the housing shell and liner and is absorbed into the air at the inner surface of the housing. Heat stored in the housing is also transferred to the heat exchange matrix 38 by conduction, so that at steady state, air flowing through the two sections 23, 25 of the housing 22 will be exposed to the orthogonal array of relatively massive, solid rod members 40, 42 and 42A which supply heat to the air, adding to the heat absorbed from the inner surfaces of the liners 30, 32 and 34 and housing 22. The mass of the matrix 38 is substantial enough to store a significant quantity of heat energy so that even after the fire is extinguished, the matrix 38 will heat the air for a period of time thereafter.

I have determined by experimentation that the structure of the heat exchange matrix 38 provides unexpectedly good heat storage and transfer characteristics to the andirons 10, 10′. It appears that a high rate of heat exchange between the matrix 38 and air stream is caused by continuous contact between the air and longitudinal rod members 40 in the regions between the transverse rod members 42. As the flow of air intermittently impinges on the transverse rod members 42, turbulence created in the air causes additional heat to be drawn from the longitudinal members 40 into the air in addition to the heat drawn from the transverse members 42 themselves. At the rear of the housing 22, additional turbulence is established in the air as the stream is forced to change direction along the longer, transverse rod members 42A.

The substantially open structure provided by the heat exchange matrix 38 enables a maximum amount of air to flow through the housing 22 without significant resistence while presenting a maximum surface area of the matrix defined by the rod members 40, 42 and 42A to the flow. The substantially open structure of the grid 38 also eliminates build-up of dust particles, reducing the frequency of cleaning of the housing that is required by the fin matrix structures of the prior art. The solid rod structure of the matrix 38 also is virtually indestructible and cannot be disfigured by mishandling during cleaning as in the conventional fin matrix.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein. As one example, the number of rod members constituting heat exchange matrix 38 can obviously be varied.

I claim:

1. An andiron for supporting fuel logs and for increasing heat transfer to a room, comprising a hollow, U-shaped housing with adjacent ends thereof forming, respectively, an air inlet and an air outlet; blower means at the inlet for establishing a stream of forced air through said housing; and heat exchange means in said housing for transferring heat energy to the air stream, said heat exchange means comprising an array of solid rod members including a plurality of first, horizontal, solid rod members extending transversely between and in heat exchange contact with opposite sidewalls of said housing, said first rod members being spaced apart vertically from each other and lying in a plane normal to the air stream and a plurality of second, horizontal, longitudinally extending solid rod members lying in a plane parallel to the air stream and in heat exchange contact with a rear wall of said housing, said first and second rod members being interleaved and in direct heat exchange contact with each other for increased heat absorption and heat transfer efficiency to the stream of forced air flowing thereover.

2. The andiron of claim 1, wherein said first rod members are located in a plurality of planes normal to the path of said air stream and spaced apart from each other along said air stream path, the first rod members in successive ones of said normal planes interrupting normal continuous heat exchange contact of air along said longitudinally extending second rod members at points of intersection between said first and second rod members, and creating areas of turbulence in the air stream at such points with a resultant additional extraction of heat from said first and second rod members.

3. The andiron of claim 1 or claim 4, wherein said second rod members are located in a plurality of planes parallel to the air stream.

4. The andiron of claim 1, wherein said housing includes an inner liner, said inner liner containing vertical cut out portions for receiving and supporting ends of said first and second rod members.

5. The andiron of claim 1, including adjustable air director means at the outlet of said housing.

6. The andiron of claim 1, including vertical, solid rod means adjacent the inlet and outlet of said housing, said vertical rod means being fixed to and supporting ends of said second rod members.

* * * * *